US007255232B2

(12) United States Patent
Kakuda

(10) Patent No.: US 7,255,232 B2
(45) Date of Patent: Aug. 14, 2007

(54) PACKAGING BOX

(75) Inventor: Tsunenari Kakuda, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/923,721

(22) Filed: Aug. 24, 2004

(65) Prior Publication Data

US 2005/0077344 A1 Apr. 14, 2005

(30) Foreign Application Priority Data

Sep. 1, 2003 (JP) ..... 2003-308285

(51) Int. Cl.
*B65D 85/00* (2006.01)

(52) U.S. Cl. ..... 206/526; 206/527; 229/100; 229/800

(58) Field of Classification Search ..... 206/525, 206/526, 527, 459.5; 229/100, 124, 165–171, 229/198.2, 800

See application file for complete search history.

(56) References Cited

U.S. PATENT DOCUMENTS 3,157,342 A * 11/1964 Grady ..... 229/122
3,647,058 A * 3/1972 Farguhar ..... 206/526
3,901,383 A * 8/1975 Witt ..... 206/526
4,068,793 A * 1/1978 Gardner ..... 229/800
4,158,410 A * 6/1979 Novatny ..... 206/527
4,469,273 A * 9/1984 Smith ..... 229/125.19
4,957,202 A * 9/1990 Yoshiki et al. ..... 206/734
5,667,072 A * 9/1997 Chang ..... 206/320
6,892,876 B1 * 5/2005 Aubry et al. ..... 206/232

* cited by examiner

*Primary Examiner*—Luan K. Bui
(74) *Attorney, Agent, or Firm*—Sughrue Mion, PLLC

(57) ABSTRACT

A packaging box in which, in one plate and one lid plate connected to an upper end portion of the side plate constituting the packaging box, one creasing line parallel to the upper end portion is formed for each, and two cut lines are formed so as to connect the end portions of the creasing lines. Provided is a packaging box from which a stored article can be easily taken out when a lid plate is opened, and which can endure a compressive stress imposed when a multiple number of the boxes are piled up.

6 Claims, 3 Drawing Sheets

PACKAGING BOX

BACKGROUND OF THE INVENTION

1. Field of the Invention

The present invention relates to a packaging box, from which stored articles can be easily taken out when a lid plate is opened, and which can endure a compressive stress when a multiple number of the boxes are piled up. The packaging box of the present invention is preferably used for, in particular, storing two or more inner boxes containing recording materials.

2. Description of the Background

Conventionally, packaging boxes represented by corrugated fiberboard boxes have been widely used to store two or more stored articles in a lot. A typical packaging box has a rectangular or rectangular parallelepiped storage space constituted by one bottom plate and four side plates, and has a structure enabling storage of stored articles in a lot. Further, a lid plate is connected to an upper end portion of at least one side plate, and the storage space can be covered from the above or opened by folding the lid plate at the aforementioned upper end portion. A lid plate may be connected to the upper end portions of all the four side plates, or only to the upper end portions of a part of the side plates.

It is generally desired that stored articles should be efficiently stored in such a packaging box. For example, it is often desired that two or more inner boxes should be loaded to fill the storage space of the packaging box substantially without gaps. When inner boxes storing light-shielded medical recording materials are stored, two or more of the inner boxes are loaded without gaps along one side plate of the packaging box. If the inner boxes are loaded without gaps as described above, the space can be efficiently utilized, and risks of moving or damaging of the inner boxes in the packaging box during transport can be reduced.

However, if the inner boxes are loaded without gaps as described above, a problem arises that it becomes difficult to take out the inner boxes from the packaging box. That is, even if it is attempted to take out an inner box by inserting fingers between a side plate of the packaging box and the inner box, it often fails since there is no space for inserting fingers. Therefore, the inner box may be slid out by reversing the packaging box and vertically shaking it while the lid plate of the packaging box is opened. However, the inner box is often slid out too swiftly, and accidents resulting in damage of the inner box content often occur. To avoid such a situation, the side plate of the packaging box may be broken to take out the inner boxes. However, if a part of the packaging box is broken, the packaging box cannot be reused, and therefore it is not preferred.

To solve such a problem, a packaging box has been proposed which is designed so that a space for inserting fingers should be formed in a portion across a side plate and a lid plate when the lid plate of the packaging box is opened. For example, Japanese Patent Laid-open Publication (Kokai) No. 2002-264923 (Publication 1) and Japanese Utility Model Laid-open Publication No 5-19119 (Publication 2) disclose a packaging box in which two parallel cut lines are formed across a side plate and a lid plate connected to the side plate, and two folding lines parallel to each other connecting the end portions of two of the cut lines are formed. When the lid plate of this packaging box is opened, a portion between the two cut lines is bent so that it should protrude outward, thereby providing a space for placing fingers on the inner box.

In the packaging boxes described in Publications 1 and 2, a mechanism for forming a space for placing fingers when the lid plate is opened is provided in facing side plates and lid plates connected to the side plates. And, it is intended that both of the lid plates connected to the facing side plates are opened to form two spaces, and fingers are inserted into each space to hold the both ends of the inner box and thereby take out the inner box. However, because parallel cut lines are formed along the same direction in the facing side plates and the lid plates connected to the side plates in these packaging boxes, they suffer from a problem of poor strength against a compressive stress imposed along the direction of the cut lines. Such a stress is likely to be imposed when a multiple number of the packaging boxes are piled up, and problems are likely to occur in practical use.

Further, because at least four cut lines and at least four folding lines must be formed in the packaging boxes described in Publications 1 and 2, time and labor are required for manufacture of the boxes. Furthermore, a lid plate must be connected to each of the facing side plates in order to form the mechanism for forming a space in the packaging boxes described in Publications 1 and 2, the degree of freedom in the design of the packaging box is limited. Moreover, to take out an inner box by holding both ends of the box with fingers as described in Publications 1 and 2, both of the lid plates connected to the facing side plates must be opened, and it cannot be considered that the time required to take out the inner box is short.

SUMMARY OF THE INVENTION

An object of the present invention is to solve the problems of the prior art described above. That is, the object of the present invention is to provide a practically useful packaging box from which a stored article can be easily taken out when a lid plate is opened, and which can endure a compressive stress imposed when a multiple number of the boxes are piled up. Further, another object of the present invention is to provide a packaging box which can be more easily manufactured compared with conventional packaging boxes such as those described in Publications 1 and 2, and has a high degree of freedom in the design of the packaging box.

The inventors of the present invention assiduously studied in order to achieve the above objects. As a result, they found that the packaging box of the present invention having the following configurations can solve the problems of the prior art.

(1) A packaging box having at least one side plate and at least one lid plate connected to an upper end portion of the side plate, wherein a first creasing line parallel to the upper end portion of the side plate is formed in the side plate, a second creasing line parallel to the upper end portion of the side plate is formed in the lid plate, a first cut line is formed so as to connect the left end portion of the first creasing line formed in the side plate and the left end portion of the second creasing line formed in the lid plate, a second cut line is formed so as to connect the right end portion of the first creasing line formed in the side plate and the right end portion of the second creasing line formed in the lid plate, and the first creasing line, the second creasing line, the first cut line and the second cut line are formed only in one side plate and one lid plate connected to the side plate among those constituting the packaging box.

(2) The packaging box according to (1), wherein the first cut line and the second cut line are straight.

(3) The packaging box according to (2), wherein the first cut line and the second cut line are parallel to each other.

(4) The packaging box according to any one of (1) to (3), wherein a third creasing line parallel to the first creasing line is formed between the first cut line and the second cut line formed in the side plate.

(5) The packaging box according to any one of (1) to (4), wherein curvilinear slits or through holes are independently formed at the lower end portion of the first cut line, the lower end portion of the second cut line, the upper end portion of the first cut line and the upper end portion of the second cut line so that the cut lines should be connected to the first creasing line and the second creasing line via the curvilinear slits or through holes.

(6) The packaging box according to (5), wherein curvilinear slits of 2 to 20 R are independently formed at the lower end portion of the first cut line, the lower end portion of the second cut line, the upper end portion of the first cut line and the upper end portion of the second cut line.

(7) The packaging box according to any one of (1) to (6) which has at least one bottom plate and two pairs of facing side plates for storing n of flat inner boxes in a storage space formed by the bottom plate and side plates, wherein, one pair of facing side plates constituting the packaging box have substantially the same size as that of a side plate constituting the inner box and having the largest area, and another pair of facing side plates constituting the packaging box have a width n times the thickness of the inner box.

(8) The packaging box according to (7), wherein a label is stuck on a surface of a side plate to be brought into contact with an inside surface of a side plate of the packaging box among side plates constituting the inner box, and the label has a coefficient of static friction (JIS P8147) of 0.20 to 0.40 against the inside surface of the side plate of the packaging box.

From the packaging box of the present invention, a stored article can be easily taken out when the lid plate is opened, and the packaging box of the present invention can endure a compressive stress imposed when a multiple number of the boxes are piled up. Further, the packaging box of the present invention can be more easily manufactured compared with conventional packaging boxes, and has a high degree of freedom in the design of the packaging box.

BEST MODE FOR CARRYING OUT THE INVENTION

Hereafter, the packaging box of the present invention will be explained in detail. In the present specification, the ranges indicated with "to" mean ranges including numerical values before and after "to" as the lower limit values and the upper limit values, respectively. In the present specification, the term "parallel" means that an intersection angle of two straight lines is not more than 15 degrees, preferably not more than 10 degrees. Further, the term "cut line" used in the present specification is used as a concept including both penetrating slits continuously formed in a line and penetrating slits intermittently formed in a line (for example, perforations).

The packaging box of the present invention has at least one lid plate and at least one side plate connected to the upper end portion of the side plate. So long as the packaging box of the present invention is a box having such a side plate and a lid plate and has a packaging function, structures of bottom plate, side plate, lid plate and so forth are not particularly limited.

Figure 1:
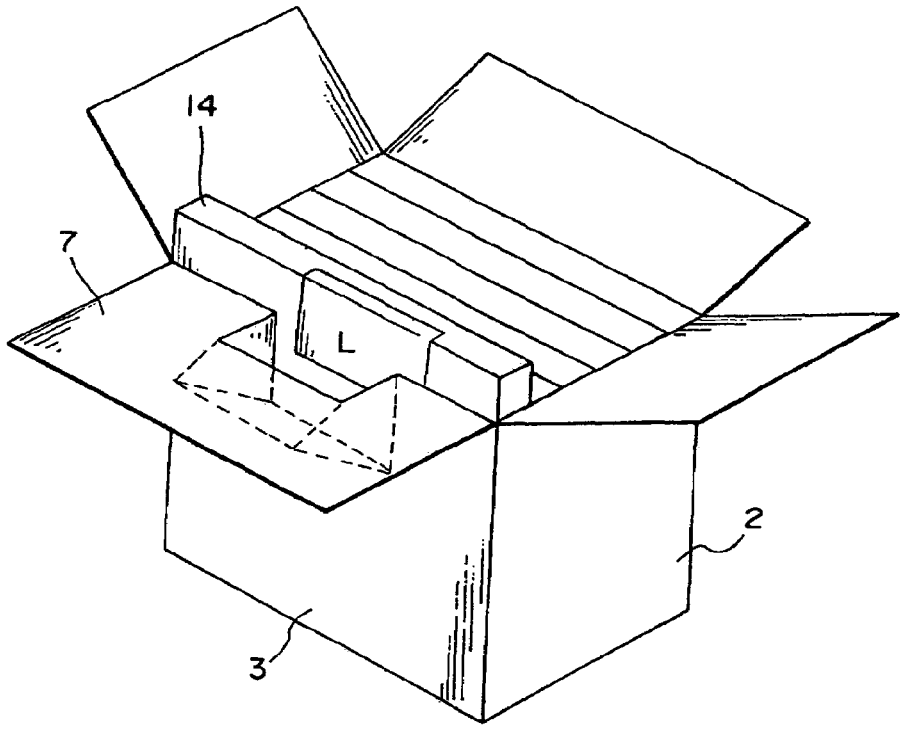
FIG. 1 is a perspective view of an embodiment of the packaging box of the present invention in a state that the lid plate is opened.

A typical example of the packaging box of the present invention has a rectangular or rectangular parallelepiped storage space constituted by one bottom plate and four side plates, and has a structure enabling storage of stored articles in a lot (for example, see FIG. 1). The shape of the storage space can be suitably designed depending on the shape of articles to be stored such as inner boxes. For example, the storage space of the packaging box of the present invention is designed so that two or more inner boxes can be stored without gaps. The number of inner boxes stored in the packaging box of the present invention is not particularly limited, and it is usually 2 to 20, preferably 4 to 10.

The packaging box of the present invention is preferably used for storing two or more inner boxes containing two or more sheet-like recording materials. In particular, it is preferably used for storing two or more inner boxes containing light-shielded medical recording materials (for example, about 4.5 kg per box) (FIG. 1). The inner box 14 containing light-shielded medical recording materials has a flat shape as shown in FIG. 1. One pair of facing side plates 1, 3 constituting the packaging box of the present invention are preferably designed to have substantially the same size as that of a side plate constituting the flat inner box 14 and having the largest area (also see FIG. 2). Further, another pair of facing side plates 2, 4 constituting the packaging box of the present invention are preferably designed to have a width of substantially an integral multiple of the thickness of the flat inner box.

The packaging box of the present invention is designed so that, when the lid plate 7 is opened, a space for inserting fingers should be formed across the lid plate 7 and the side plate 3 connected thereto (FIG. 1). A mechanism for forming such a space is formed only in one side plate and one lid plate connected thereto which constitute the packaging box of the present invention.

The design and function of this mechanism will be explained with reference to a development of one embodiment of the packaging box of the present invention shown in FIG. 2.

Figure 2:
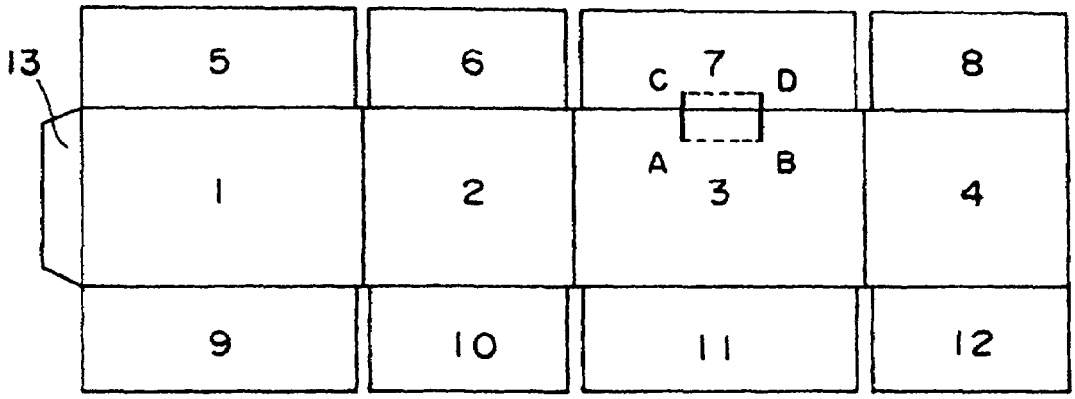
FIG. 2 is a development of an embodiment of the packaging box of the present invention.

FIG. 2 shows a development of a typical packaging box such as a corrugated fiberboard box in which the mechanism for forming a space is formed. The development of FIG. 2 comprises four side plates 1, 2, 3, 4, lid plates 5, 6, 7, 8 connected to the upper end portions of the respective side plates, bottom plates 9, 10, 11, 12 connected to the lower end portions of the side plates, and a joint plate 13 to be connected to the left end portion of the side plate 1.

The mechanism for forming a space is formed across the side plate 3 and the lid plate 7 connected thereto as follows. A first creasing line parallel to the upper end portion of the side plate 3 is formed between A and B in the side plate 3. Further, a second creasing line parallel to the upper end portion of the side plate 3 is formed between C and D in the lid plate 7. These creasing lines are formed by creasing from the inside of the packaging box. The creasing is generally performed by a method of pressing a blade or the like. Further, a first cut line connecting the left end portion A of the first creasing line formed in the side plate 3 and the left end portion C of the second creasing line formed in the lid plate 7 is formed. Further, a second cut line connecting the right end portion B of the first creasing line formed in the side plate 3 and the right end portion D of the second creasing line formed in the lid plate 7 is formed.

The lengths of the creasing lines and the cut lines are not particularly limited so long as they substantially have lengths that can secure a space for inserting fingers when the lid plate 7 is opened. The lengths of the first creasing line and the second creasing line are usually 3 to 13 cm, preferably 5 to 11 cm. Further, the lengths of the first cut line and the second cut line are usually 5 to 20 cm, preferably 6 to 15 cm. The ratio of the length of the cut line in the side plate and that in the lid plate is usually 1:3 to 5:1, preferably 1:1 to 3:1.

Specific examples include a mechanism having the lengths of the first creasing line and the second creasing line of 8 cm, the lengths of the first cut line and the second cut line of 12 cm, and the ratio of the length of the cut line in the side plate and the length in the lid plate of 2:1 (first specific example). Further, as another specific example, a mechanism having the lengths of the first creasing line and the second creasing line of 8 cm, the lengths of the first cut line and the second cut line of 9 cm, and the ratio of the length of the cut line in the side plate and the length in the lid plate of 1.25:1 can be exemplified (second specific example).

To assemble the packaging box having the development shown in FIG. 2, the plates can be bend along the lines between a side plate and a side plate connected to the side plate, between a side plate and a lid plate connected to the side plate, between a side plate and a bottom plate connected to the side plate, and between the side plate 1 and the joint plate 13 connected to the side plate 1. For the above bending operation, the bottom plates 10, 12 are usually bent before the bottom plates 9, 11 are bent. Further, the lid plates 6, 8 are usually bent before the lid plates 5, 7 are bent. Further, the joint plate 13 and the side plate 4 are overlapped and bonded with an adhesive or the like.

Figure 3:
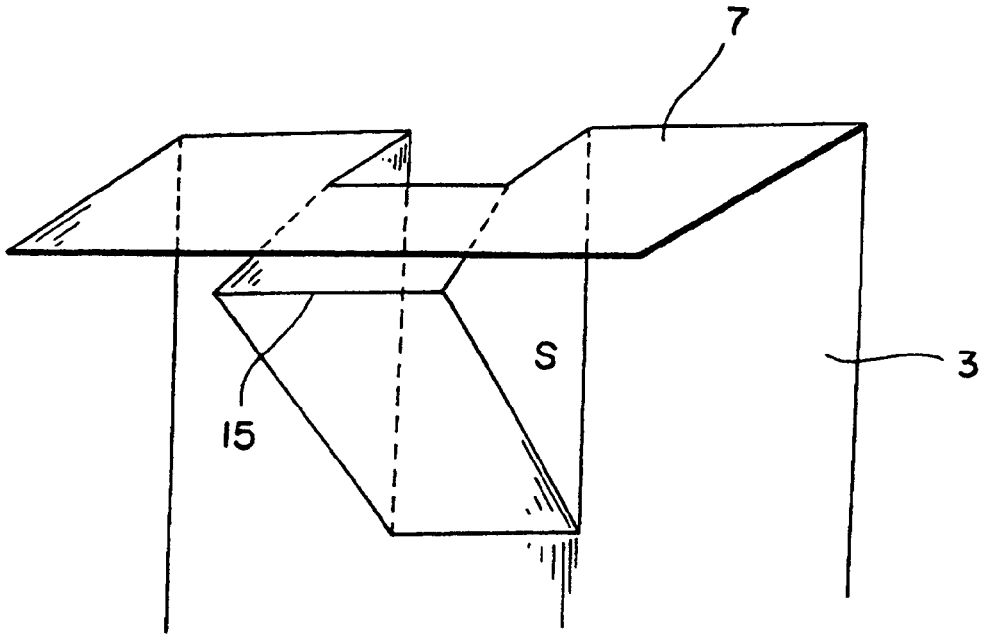
FIG. 3 is a perspective view of an embodiment of a mechanism formed in a side plate and a lid plate connected to the side plate of the packaging box of the present invention.

The packaging box assembled as described above has the same outer shape as usual packaging boxes when the lid plates 5, 6, 7, 8 are closed. When opening of the lid plate 7 is started, the mechanism portion formed across the side plate 3 and the lid plate 7 simultaneously starts to protrude outward from the packaging box. As a result, the bent portion 15 having constituted the upper end portion of the side plate 3 is bent so that it should protrude furthest outward. Thus, a space S for inserting fingers is formed across the side plate 3 and the lid plate 7 as shown in FIG. 3. An inner box 14 can be easily taken out by placing fingers on the side surface of the inner box 14 using this space and raising it upward while gently applying a pressure inward (FIG. 1).

The inner box loaded in the packaging box of the present invention is preferably provided with a label L having an anti-slipping function at a site touched by fingers inserted into the space. The label L preferably has a coefficient of static friction of 0.20 to 0.40, more preferably 0.20 to 0.30, further preferably 0.25 to 0.30, against the inside surface of the side plate of the packaging box with which the label L is brought into contact. The coefficient of static friction is measured by the method according to JIS P8147 (inclination method). That is, a sheet made of the same material as that of the side plate of packaging box is fixed on an inclined plate, a label is statically placed thereon, and further the inclination angle θ of the inclined plate is gradually increased while a weight having a width 35 mm, a length of 75 mm, and a weight of 190 g is placed on the label. The inclination angle θ at which the weight starts moving is measured, and tan θ is assumed as the coefficient of static friction.

In the present invention, art paper of which surface is coated with a resin and so forth can be exemplified as preferred examples of the label. In particular, coated paper treated with latex can be preferably used. As a specific example, "Coat Carry" (trade name, produced by Sato Corporation) and the like can be exemplified. Information on the content of the inner box or the like can be printed on the label L beforehand as required.

The space for inserting fingers is also effective when the inner box 14 is loaded in the packaging box again. In general, it is relatively difficult to load the final inner box 14 into the packaging box since the remaining storage space is limited. However, with the packaging box of the present invention, it is relatively easy to insert hands and put aside already stored inner boxes to secure a space for storing the final inner box by utilizing the space formed across the side plate 3 and the lid plate 7. Further, when the final inner box is inserted into the space secured as described above, the final inner box can be smoothly inserted without imposing an impact by sliding the final inner box downward while placing hands thereon by utilizing the space formed across the side plate 3 and the lid plate 7.

When insertion or removal of the inner box 14 is completed, and the lid plate 7 is closed, the packaging box returns to the same shape as usual packaging box, and can be stored or transported as it is. Therefore, the packaging box of the present invention is more useful compared with packaging boxes of conventional types in which a side plate of packaging box or the like is broken when inner boxes are taken out.

The position of the mechanism for forming a space is not particularly limited so long as it is formed across the side plate 3 and the lid plate 7. Usually, it is preferably designed to be positioned substantially at the center of the upper end portion of the side plate 3. Further, it is preferable to form one mechanism for forming a space across the side plate 3 and the lid plate 7. Although two or more mechanisms can be formed, cares must be taken in such a case by considering the size of each mechanism or the like so that the strength of the packaging box should not be degraded.

Further, the mechanism for forming a space must be formed only in one side plate and one lid plate connected thereto which constitute the packaging box of the present invention. If the mechanism for forming a space is formed in each of facing side plates and lid plates connected thereto as in the packaging boxes described in Publications 1 and 2, packaging boxes are easily damaged when a multiple number of the packaging boxes are piled up. However, when the mechanism is formed only in one side plate and one lid plate connected thereto as in the present invention, the packaging box is hardly damaged. Therefore, the packaging box of the present invention is more suitable for transport and storage.

The mechanism for forming a space may have a structure other than those of the embodiments shown in FIGS. 1 to 3 so long as the requirements of Claim 1 are satisfied.

Figure 4:
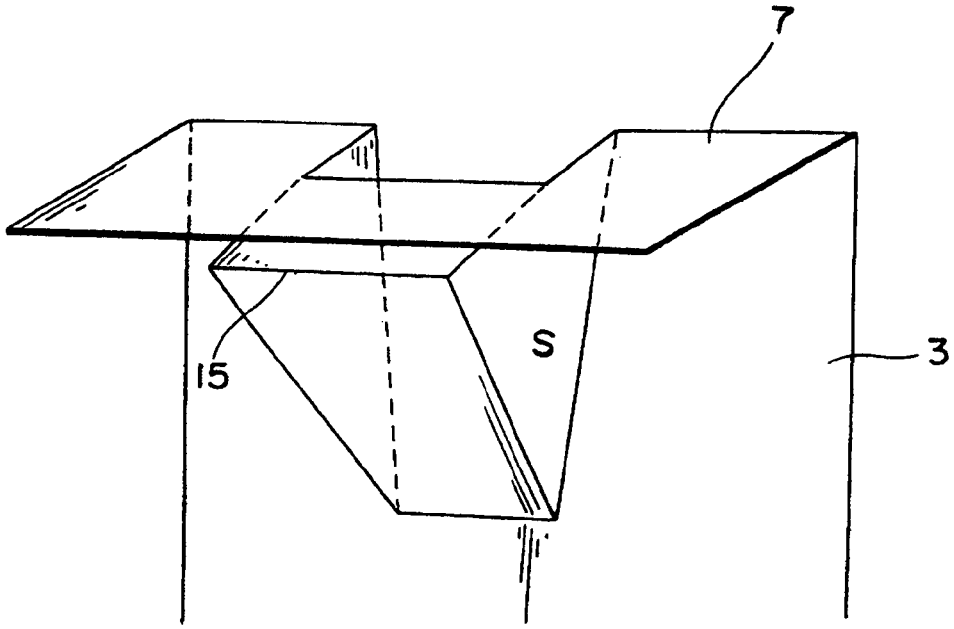
FIG. 4 is a perspective view of another embodiment of a mechanism formed in a side plate and a lid plate connected to the side plate of the packaging box of the present invention.

For example, the first cut line and the second cut line do not necessarily need to be parallel to each other. For example, they may be designed so that the spacing between the first cut line and the second cut line should gradually narrow or, to the contrary, gradually widen, toward the lower portion of the side plate 3. FIG. 4 shows the opened state of a packaging box designed so that the spacing between the first cut line and the second cut line should gradually narrow toward the lower portion of the side plate 3.

Further, the first cut line and the second cut line do not necessarily need to be parallel to each other also in the lid plate 7. They may be designed so that the spacing between the first cut line and the second cut line should gradually narrow or, to the contrary, gradually widen, toward the upper end portion of the side plate 3.

By forming the first cut line and the second cut line not parallel to each other as described above, a stress imposed along the direction of the cut lines can be dispersed, and occurrence of a split formed from the cut line can be effectively prevented.

Further, the first cut line and the second cut line do not necessarily need to be straight in the development. For example, they may be straight in the side plate 3 and the lid plate 7 and bent at the upper end portion of the side plate 3. Furthermore, the first cut line and the second cut line may include a curvilinear portion.

Figure 5:
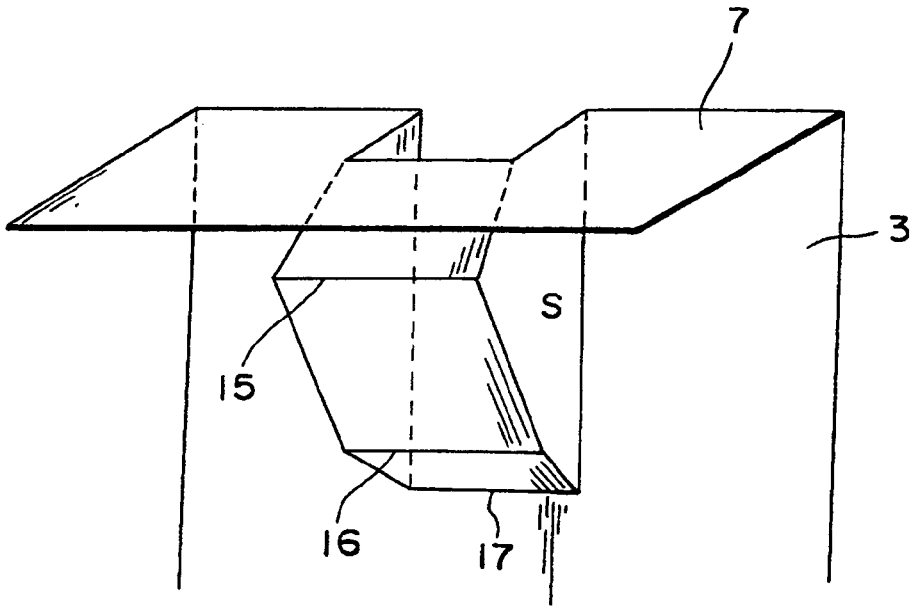
FIG. 5 is a perspective view of yet another embodiment of a mechanism formed in a side plate and a lid plate connected to the side plate of the packaging box of the present invention.

Further, in the present invention, an embodiment in which a third creasing line parallel to the first creasing line is formed between the first cut line and the second cut line formed in the side plate 3 can be preferably adopted. FIG. 5 shows an opened state of the lid plate 7 of a packaging box having a mechanism including such a third creasing line 16. Because the side plate is bent along the third creasing line 16 so as to protrude outward, such a structure has an advantage that the space S can be plentifully secured in comparison with the state shown in FIG. 3, in which the third creasing line is not formed. Therefore, fingers are more easily inserted from the above into the packaging box, and the inner box can be more easily taken out. Further, if the third creasing line 16 is formed, the bent sites increase, and therefore an advantage of easier opening of the lid plate 7 is also obtained.

The third creasing line 16 is preferably formed in the vicinity of the halfway between the first creasing line 17 and a bent portion 15 having constituted the upper end portion of the side plate. For example, when the spacing between the first creasing line 17 and the bent line 15 is 8 cm in length, it is preferable to form the third creasing line 16 at a position of 2 to 6 cm, preferably at a position of 3 to 5 cm, from the first creasing line 17.

Further, in the present invention, the mechanism may be designed so that curvilinear slits or through holes should be independently formed at the lower end portion of the first cut line, the lower end portion of the second cut line, the upper end portion of the first cut line and the upper end portion of the second cut line, and thus the cut lines should be connected to the first creasing line or the second creasing line via the curvilinear slits or through holes. For example, the embodiment shown in FIG. 6 can be adopted as a variation of a partial structure represented by A-B-D-C in FIG. 2.

Figure 6:
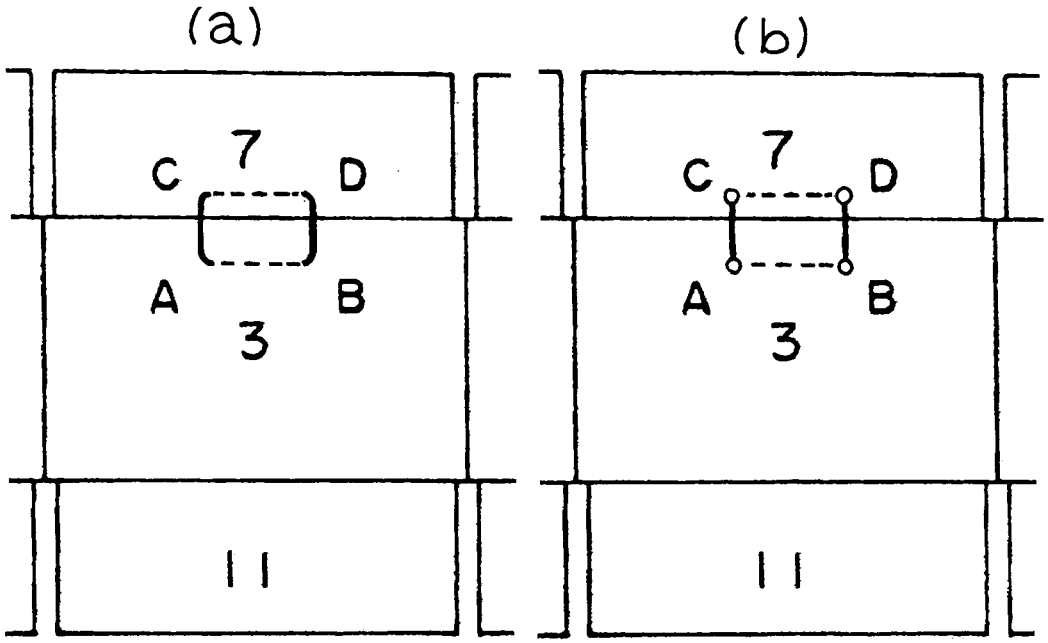
FIG. 6 is a development of a partial structure represented by A-B-D-C in FIG. 2

In the embodiment shown in FIG. 6(*a*), curvilinear slits are formed at the lower end portion (A) of the first cut line, the lower end portion (B) of the second cut line, the upper end portion (C) of the first cut line and the upper end portion (D) of the second cut line. The curvilinear slits are preferably of 2 to 20 R, more preferably 4 to 14 R, further preferably 6 to 8 R. In the aforementioned first specific example and the second specific example, for example, 7 R-slits can be formed at the four sites, A, B, C and D. The length of the curvilinear slits is preferably 0.7 cm or longer, more preferably 1.0 cm or longer.

In the embodiment shown in FIG. 6(*b*), through holes are formed at the lower end portion (A) of the first cut line, the lower end portion (B) of the second cut line, the upper end portion (C) of the first cut line and the upper end portion (D) of the second cut line. The structure of the through hole is not particularly limited, and it preferably has a circular or elliptical shape, more preferably a circular shape. The diameter of circular through hole is preferably 2 to 20 mm, more preferably 3 to 10 mm, further preferably 5 to 8 mm.

All the curvilinear slits or through holes formed as described above may have identical shapes, or each may have a different shape. Preferably, all of them have identical shapes.

By forming curvilinear slits or through holes at the lower end portions and the upper end portions of the cut lines as described above, a load imposed on the lower end portions and the upper end portions of the cut lines can be dispersed. In particular, a relatively large load is imposed on the lower end portions and the upper end portions of the cut lines when the lid body is opened or closed, and therefore portions in the vicinity of the lower end portions and the upper end portions of the cut lines are easily split or broken. If curvilinear slits or through holes are formed according to the present invention, such damages can be favorably prevented.

In the packaging box of the present invention, the mechanism for forming a space is disposed only in one side plate and a lid plate connected thereto, and is not formed in other side plates and lid plates. Therefore, it has an advantage of relatively high degree of freedom in the design of the packaging box. For example, it is possible to design a packaging box having one lid plate so as to simplify the opening and closing operations. Such a design cannot be achieved with the packaging boxes described in Publications 1 and 2.

The material constituting the packaging box of the present invention is not particularly limited, and a corrugated fireboard, which is suitable for mass production and relatively inexpensive, is preferably used. Further, the material of the inner box stored in the packaging box is not particularly limited either, and a corrugated fireboard is preferably used. In particular, a core-reinforced corrugated fireboard is preferably used since it has small irregularities on the surface. The basis weight of the corrugated fireboard is preferably 150 to 210 g/m$^2$, more preferably 170 to 190 g/m$^2$.

The present disclosure relates to the subject matter contained in Japanese Patent Application No. 308285/2003 filed on Sep. 1, 2003, which is expressly incorporated herein by reference in its entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A packaging box having at least one side plate and at least one lid plate connected to an upper end portion of the side plate, wherein a first creasing line parallel to the upper end portion of the side plate is formed in the side plate, a second creasing line parallel to the upper end portion of the side plate is formed in the lid plate, a first cut line is formed so as to connect the left end portion of the first creasing line formed in the side plate and the left end portion of the second creasing line formed in the lid plate, a second cut line is formed so as to connect the right end portion of the first creasing line formed in the side plate and the right end portion of the second creasing line formed in the lid plate, and the first creasing line, the second creasing line, the first cut line and the second cut line are formed only in one side plate and one lid plate connected to the side plate among those constituting the packaging box, and the packaging box has at least one bottom plate and two pairs of facing side plates for storing n of flat inner boxes in a storage space formed by the bottom plate and side plates, wherein, one pair of facing side plates constituting the packaging box have substantially the same size as that of a side plate constituting the inner box and having the largest area, another pair of facing side plates constituting the packaging box have a width n times the thickness of the inner box, and a label is stuck on a surface of a side plate to be brought into contact with an inside surface of a side plate of the packaging box among side plates constituting the inner box, and the label has a coefficient of static friction measured in accordance with Japanese Industrial Standard JIS P8147 of 0.20 to 0.40 against the inside surface of the side plate of the packaging box.

2. The packaging box according to claim 1, wherein the first cut line and the second cut line are straight.

3. The packaging box according to claim 2, wherein the first cut line and the second cut line are parallel to each other.

4. The packaging box according to claim 1, wherein a third creasing line parallel to the first creasing line is formed between the first cut line and the second cut line formed in the side plate.

5. The packaging box according to claim 1, wherein curvilinear slits or through holes are independently formed at the lower end portion of the first cut line, the lower end portion of the second cut line, the upper end portion of the first cut line and the upper end portion of the second cut line so that the cut lines should be connected to the first creasing line and the second creasing line via the curvilinear slits or through holes.

6. The packaging box according to claim 5, wherein the curvilinear slits having a radius of curvature R of 2 to 20 mm are independently formed at the lower end portion of the first cut line, the lower end portion of the second cut line, the upper end portion of the first cut line and the upper end portion of the second cut line.

* * * * *